US010852058B2

(12) United States Patent
Millar et al.

(10) Patent No.: US 10,852,058 B2
(45) Date of Patent: Dec. 1, 2020

(54) METHOD TO PRODUCE LNG AT GAS PRESSURE LETDOWN STATIONS IN NATURAL GAS TRANSMISSION PIPELINE SYSTEMS

(71) Applicants: 1304338 Alberta Ltd, Edmonton (CA); 1304342 Alberta Ltd, Edmonton (CA)

(72) Inventors: MacKenzie Millar, Edmonton (CA); Jose Lourenco, Edmonton (CA)

(73) Assignees: 1304338 Alberta Ltd., Edmonton (CA); 1304342 Alberta Ltd.

( * ) Notice: Subject to any disclaimer, the term of this patent is extended or adjusted under 35 U.S.C. 154(b) by 0 days.

(21) Appl. No.: 14/649,858

(22) PCT Filed: Dec. 4, 2013

(86) PCT No.: PCT/CA2013/050929

§ 371 (c)(1),
(2) Date: Jun. 4, 2015

(87) PCT Pub. No.: WO2014/085927

PCT Pub. Date: Jun. 12, 2014

(65) Prior Publication Data

US 2015/0345858 A1 Dec. 3, 2015

(30) Foreign Application Priority Data

Dec. 4, 2012 (CA) ..... 2798057

(51) Int. Cl.
*F25J 1/00* (2006.01)
*F25J 1/02* (2006.01)

(52) U.S. Cl.
CPC ..... *F25J 1/0022* (2013.01); *F25J 1/004* (2013.01); *F25J 1/0045* (2013.01); *F25J 1/0201* (2013.01);

(Continued)

(58) Field of Classification Search
CPC ..... F25J 1/0232; F25J 2260/10; F25J 1/0035–0045
See application file for complete search history.

(56) References Cited

U.S. PATENT DOCUMENTS 2,168,438 A 8/1939 Carrier
3,002,362 A 10/1961 Morrison
(Continued)

FOREIGN PATENT DOCUMENTS

CA 1 048 876 A1 2/1979
CA 2 422 893 A1 2/2002
(Continued)

OTHER PUBLICATIONS

Hudson, H.M., et al., "Reducing Treating Requirements for Cryogenic NGL Recovery Plants," Proceedings of the 80th Annual Convention of the Gas Processors Association, Mar. 12, 2001, San Antonio, Texas, 15 pages.

(Continued)

*Primary Examiner* — Ana M Vazquez
(74) *Attorney, Agent, or Firm* — Christensen O'Connor Johnson Kindness, PLLC

(57) ABSTRACT

There is described a method to produce LNG at gas pressure letdown stations. A high pressure gas stream is pre-cooled, dewatered, and then divided into two streams: a diverted LNG production stream (LNG stream) and a gas to end users stream (User stream). Carbon dioxide is removed from the LNG stream and the LNG stream is compressed. The LNG stream is then precooled by passing through one or more heat exchangers. Hydrocarbon condensate is removed from the LNG steam by passing the LNG stream through a first Knock Out drum. The LNG stream is then depressured by passing through a JT valve to depressurize the gas vapour (Continued)

exiting the first Knock Out drum and discharge it into a second Knock Out drum where the LNG is captured.

1 Claim, 1 Drawing Sheet

(52) U.S. Cl.
CPC ..... *F25J 1/0232* (2013.01); *F25J 2210/06* (2013.01); *F25J 2220/62* (2013.01); *F25J 2220/64* (2013.01); *F25J 2240/40* (2013.01)

(56) References Cited

U.S. PATENT DOCUMENTS 3,152,194 A 10/1964 Franz et al.
3,184,926 A 5/1965 Blake
3,241,933 A 3/1966 Ploum et al.
3,280,575 A 10/1966 Drake
3,315,475 A 4/1967 Harmens
3,367,122 A 2/1968 Charles
3,653,220 A 4/1972 Foster et al.
3,735,600 A 5/1973 Dowdell et al.
3,747,359 A 7/1973 Streich
3,754,405 A 8/1973 Rosen
3,792,590 A 2/1974 Lofredo et al.
3,846,993 A 11/1974 Bates
3,859,811 A 1/1975 Duncan
3,892,103 A 7/1975 Antonelli
3,919,853 A 11/1975 Rojey
3,962,881 A 6/1976 Muska
4,033,735 A * 7/1977 Swenson ..... F25J 1/0022 62/612
4,170,115 A 10/1979 Ooka et al.
4,279,130 A 7/1981 Finch et al.
4,418,530 A 12/1983 Bodrov et al.
4,424,680 A 1/1984 Rothchild
4,430,103 A 2/1984 Gray et al.
4,444,577 A 4/1984 Perez
4,617,039 A 10/1986 Buck
4,681,612 A 7/1987 O'Brien et al.
4,710,214 A 12/1987 Sharma et al.
4,751,151 A 6/1988 Healy et al.
4,869,740 A 9/1989 Campbell et al.
4,907,405 A 3/1990 Polizzotto
4,936,888 A 6/1990 DeLong
5,026,952 A 6/1991 Bauer
5,062,270 A 11/1991 Haut et al.
5,137,558 A 8/1992 Agrawal
5,295,350 A 3/1994 Child et al.
5,329,774 A 7/1994 Tanguay et al.
5,425,230 A 6/1995 Shpak
5,440,894 A 8/1995 Schaeffer et al.
5,560,212 A 10/1996 Hansen
5,678,411 A 10/1997 Matsumura et al.
5,685,170 A 11/1997 Sorensen
5,782,958 A 7/1998 Rojey et al.
5,799,505 A 9/1998 Bonaquist et al.
5,953,935 A 9/1999 Sorensen
5,983,663 A 11/1999 Sterner
6,089,022 A 7/2000 Zednik et al.
6,089,028 A 7/2000 Bowen et al.
6,131,407 A 10/2000 Wissolik
6,138,473 A 10/2000 Boyer-Vidal
6,182,469 B1 2/2001 Campbell et al.
6,266,968 B1 7/2001 Redlich
6,286,315 B1 9/2001 Staehle
6,378,330 B1 4/2002 Minta et al.
6,432,565 B1 8/2002 Haines
6,517,286 B1 2/2003 Latchem
6,526,777 B1 3/2003 Campbell et al.
6,581,409 B2 6/2003 Wilding et al.
6,606,860 B2 8/2003 McFarland
6,640,555 B2 11/2003 Cashin
6,662,589 B1 12/2003 Roberts et al.
6,694,774 B1 * 2/2004 Rashad ..... F25J 1/0005 62/611
6,739,140 B2 5/2004 Bishop et al.
6,751,985 B2 6/2004 Kimble et al.
6,889,523 B2 5/2005 Wilkenson et al.
6,932,121 B1 8/2005 Shivers, III
6,945,049 B2 9/2005 Madsen
7,051,553 B2 5/2006 Mak et al.
7,107,788 B2 9/2006 Patel et al.
7,155,917 B2 1/2007 Baudat
7,219,502 B2 5/2007 Nierenberg
7,257,966 B2 8/2007 Lee et al.
7,377,127 B2 5/2008 Mak
8,429,932 B2 5/2013 Lourenco et al.
8,640,494 B2 2/2014 Lourenco et al.
8,850,849 B2 10/2014 Martinez et al.
8,887,513 B2 11/2014 Kotzot et al.
2002/0170297 A1 11/2002 Quine et al.
2003/0008605 A1 1/2003 Hartford et al.
2003/0019219 A1 1/2003 Viegas et al.
2003/0051875 A1 3/2003 Wilson
2003/0182947 A1 10/2003 Kimble et al.
2003/0196452 A1 10/2003 Wilding et al.
2004/0065085 A1 4/2004 Madsen
2005/0086974 A1 4/2005 Steinbach et al.
2005/0244277 A1 11/2005 Hurst et al.
2006/0213222 A1 9/2006 Whitesell
2006/0213223 A1 9/2006 Wilding et al.
2006/0242970 A1 11/2006 Yang et al.
2007/0062216 A1 3/2007 Mak et al.
2007/0107465 A1 5/2007 Turner et al.
2008/0016910 A1 1/2008 Brostow et al.
2009/0084132 A1 * 4/2009 Dragomir ..... F25J 1/0022 62/613
2009/0113928 A1 5/2009 Vandor et al.
2009/0249829 A1 10/2009 Lourenco et al.
2009/0282865 A1 11/2009 Martinez et al.
2010/0242499 A1 9/2010 Lourenco et al.
2010/0287985 A1 11/2010 Martinez et al.
2011/0036122 A1 2/2011 Betting et al.
2011/0094263 A1 * 4/2011 Wilding ..... F25J 1/0022 62/613
2011/0174017 A1 7/2011 Victory et al.
2012/0060554 A1 * 3/2012 Schmidt ..... C10L 3/105 62/620
2012/0169049 A1 7/2012 Oxner et al.
2013/0333416 A1 12/2013 Lourenco et al.
2015/0143842 A1 5/2015 Lourenco et al.

FOREIGN PATENT DOCUMENTS

CA 2 467 338 A1 7/2003
CA 2 516 785 A1 9/2004
CA 2 552 366 A1 7/2005
CA 2 299 695 A1 7/2007
CA 2 536 075 C 7/2007
CA 2 318 802 A1 2/2008
CA 2 728 716 A1 1/2011
CA 2 777 760 A1 5/2011
CA 2 763 081 A1 12/2011
CA 2 515 999 A1 12/2012
CN 1615415 A 5/2005
CN 101948706 A 1/2011
DE 4416359 A1 10/1998
EP 0482222 A1 4/1992
EP 0566285 A1 10/1993
EP 0 635 673 A1 1/1995
EP 0 780 649 A1 6/1997
FR 2 420 081 A1 10/1979
GB 1011453 12/1965
GB 2 103 354 A 2/1983
JP 3-236589 A 10/1991
JP 5-263998 A 10/1993
JP 2002295799 A 10/2002
JP 2003-165707 A 6/2003
RU 2 180 420 C2 3/2002
RU 2 232 342 C1 7/2004
WO 94/11626 A1 5/1994

(56) References Cited

FOREIGN PATENT DOCUMENTS

| | | | |
|---|---|---|---|
| WO | 97/01069 | A1 | 1/1997 |
| WO | 98/59205 | A2 | 12/1998 |
| WO | 99/31447 | A3 | 6/1999 |
| WO | 00/52403 | A1 | 9/2000 |
| WO | 03/081038 | A1 | 10/2003 |
| WO | 03/095913 | A1 | 11/2003 |
| WO | 03/095914 | A1 | 11/2003 |
| WO | 2004/010480 | A1 | 1/2004 |
| WO | 2004/052511 | A1 | 6/2004 |
| WO | 2004/109180 | A1 | 12/2004 |
| WO | 2004/109206 | A1 | 12/2004 |
| WO | 2005/045337 | A1 | 5/2005 |
| WO | 2006/019900 | A1 | 2/2006 |
| WO | 2006/036441 | A1 | 4/2006 |
| WO | 200/6004723 | A1 | 8/2006 |
| WO | 2008/006221 | A1 | 1/2008 |
| WO | 2009/061777 | A1 | 5/2009 |
| WO | 2012/015554 | A1 | 2/2012 |
| WO | 2014/032179 | A1 | 3/2014 |

OTHER PUBLICATIONS

Hidnay, A.J., and W.H. Parrish, "Fundamentals of Natural Gas Processing," Taylor & Francis Group, Abingdon, U.K., © 2006, 440 pages.

International Search Report and Written Opinion dated Jul. 18, 2014, issued in corresponding International Application No. PCT/CA2014/050374, filed Apr. 14, 2014, 9 pages.

International Search Report and Written Opinion dated May 1, 2012, issued in corresponding International Application No. PCT/CA2012/050030, filed Jan. 18, 2012, 9 pages.

* cited by examiner

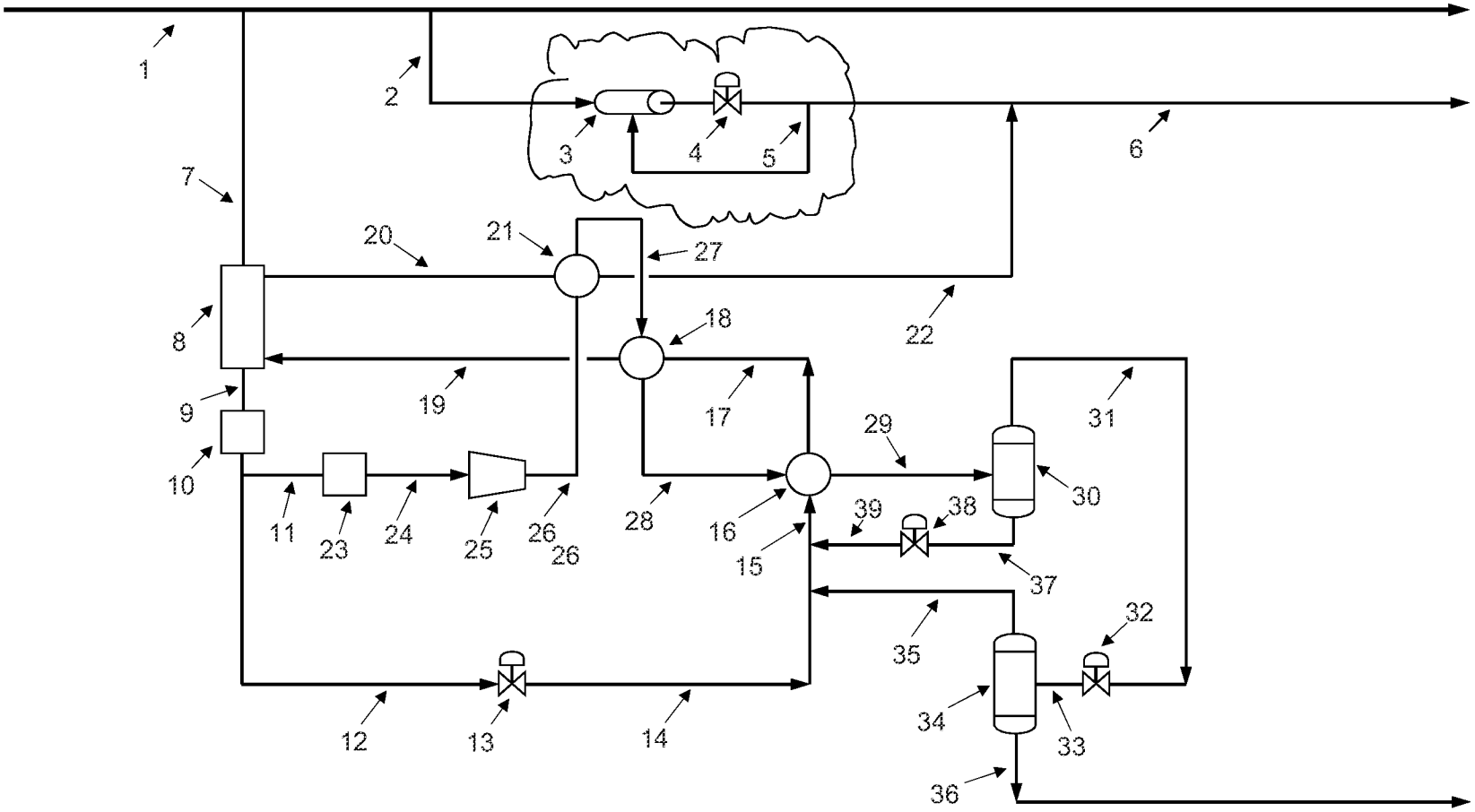
1
2
3
4
5
6
7
8
9
10
11
12
13
14
15
16
17
18
19
20
21
22
23
24
25
26
26
27
28
29
30
31
32
33
34
35
36
37
38
39

METHOD TO PRODUCE LNG AT GAS PRESSURE LETDOWN STATIONS IN NATURAL GAS TRANSMISSION PIPELINE SYSTEMS

FIELD OF THE INVENTION

The present invention relates to a method that produces LNG at gas pressure letdown stations in natural gas transmission pipeline systems using the refrigeration generated from the expansion of the gas stream to distribution.

BACKGROUND OF THE INVENTION

Canadian Patent 2,536,075 describes a process for producing Liquid Natural Gas (LNG) at Pressure letdown stations. There will hereinafter be described an alternative method of producing LNG at gas pressure letdown stations.

SUMMARY OF THE INVENTION

There is described a method to produce LNG at gas pressure letdown stations. A first step involves pre-cooling a high pressure gas stream entering a gas pressure letdown station. A second step involves dewatering the high pressure natural gas stream after precooling. A third step involves splitting the dewatered high pressure natural gas stream into two streams: a diverted (LNG production) stream and a gas to end users stream. A fourth step involves removing carbon dioxide from the diverted (LNG production) stream. A fifth step involves compressing the diverted (LNG production) stream, which has been dewatered and had carbon dioxide removed. A sixth step involves precooling the diverted (LNG production) stream by passing the diverted (LNG production) stream through one or more heat exchangers downstream of the compressor. A seventh step involves removing hydrocarbon condensate from the diverted (LNG production) steam by passing the diverted (LNG production) stream through a first Knock Out drum so that the diverted (LNG production) stream exiting the first Knock Out drum is a gas vapour stream. An eighth step involves depressurizing the diverted (LNG production) stream by passing the diverted (LNG production) stream through a JT valve to depressurize the gas vapour exiting the first Knock Out drum and discharge it into a second Knock Out drum. A ninth step involves removing LNG from the diverted (LNG production) stream in the second Knock Out drum.

The disclosed invention provides a method for production of LNG at gas pressure letdown stations.

BRIEF DESCRIPTION OF THE DRAWINGS

These and other features of the invention will become more apparent from the following description in which reference is made to the appended drawing, the drawing is for the purpose of illustration only and is not intended to in any way limit the scope of the invention to the particular embodiment or embodiments shown, wherein:

FIG. 1 is a schematic diagram of a method to produce LNG at gas pressure letdown stations in natural gas transmission pipeline systems.

DETAILED DESCRIPTION OF THE PREFERRED EMBODIMENT

A method to produce LNG at gas pressure letdown stations in natural gas transmission pipeline systems will now be described with reference to FIG. 1.

This alternative method of producing LNG at gas pressure letdown stations allows for LNG to be produced at a lower capital cost but at a higher operating cost than the method described in Canadian Patent 2,536,075.

Referring to FIG. 1, a typical gas pressure letdown station in a natural gas transmission pipeline. Natural gas is delivered through a high pressure transmission pipeline 1. Stream 2 is a gas stream that is first pre-heated in heater 3 before it is depressurized through JT valve 4 (typically down to 100 psi) and then routed to end users through line 6. A gas stream 5 provides the fuel required for heater 3. This simplified process arrangement as enclosed in the cloud constitutes a standard operation at gas pressure letdown stations. In the proposed invention, stream 7 is first pre-cooled in heat exchanger 8, the cooled stream 9 is then de-watered in pre-treatment unit 10. The dryed gas stream 12 is reduced in pressure at JT valve 13 at an approximate rate of 7 F for every 100 psi pressure drop. The dry, depressurized, cool, gas stream 14 is mixed with cryogenic vapors stream 35 and stream 39 to form a cooler mixture stream 15. The cold gas stream 15 is warmed in heat exchanger 16. The warmer stream 17 gains further heat through exchanger 18 and the now yet warmer stream 19 enters heat exchanger 8 for further heating. Stream 20 is now dry and at an equivalent temperature as stream 7. Nevertheless, stream 20 is further heated at exchanger 21 before being routed through stream 22 to end users stream 6.

The dry stream 11, the diverted stream is first pretreated in pre-treatment unit 23 to remove carbon dioxide. The dry, carbon dioxide free stream 24 is then compressed in compressor 25. The compressed stream 26 enters heat exchanger 21 where it is cooled. The compressed and cooled stream 27 is further cooled in heat exchanger 18. The compressed cooled stream 28 is yet further cooled in heat exchanger 16 and the colder compressed stream 29 enters knock out drum 30 to separate the condensed fraction. The vapour stream 31 is then depressurized through JT valve 32 and the two phase stream 33 enters knock out drum 34 to where a condensed LNG stream 36 is routed to storage and a cryogenic vapour stream 35 is routed and mixed with gas stream 14. The condensed fraction stream 37 is depressurized through JT valve 38 and the two phase stream 39 is mixed with streams 14 and 35 to form a mixture stream 15. The inventive step in this process is the generation and recovery of cold in conjunction with compression of a diverted gas stream to produce LNG using JT valves at gas pressure letdown stations. The use of compression and pressure reduction to generate the Joule Thompson effect is well understood and in practice in the gas industry in various forms. The advantage of the proposed invention is the process configuration which omits the use of gas expanders and replaces it with selective compression and JT valves, allowing for a lower capital cost LNG production at gas pressure letdown stations.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the preferred embodiments set forth in the examples, but should be given a broad purposive interpretation consistent with the description as a whole.

What is claimed is:

1. A method to produce LNG at gas pressure letdown stations, comprising:

pre-cooling a pressurized natural gas stream entering a gas pressure letdown station;

dewatering the pressurized natural gas stream after pre-cooling;

splitting the dewatered pressurized natural gas stream into a diverted LNG production stream and a gas to end users stream;

cooling the diverted LNG production stream to produce LNG by:

depressurizing the gas to end users stream by passing the gas to end users stream through an end user JT valve, the gas to end users stream being unexpanded between the pressurized natural gas stream entering the gas pressure letdown station and the end user JT valve;

warming the gas to end users stream by passing the gas to end users stream through a series of heat exchangers;

removing carbon dioxide from the diverted LNG production stream;

compressing the diverted LNG production stream, which has been dewatered and had carbon dioxide removed, in a compressor, the series of heat exchangers being directly downstream of the compressor;

precooling the diverted LNG production stream by passing the diverted LNG production stream through the series of heat exchangers directly downstream of the compressor;

removing hydrocarbon condensate from the diverted LNG production stream by passing the diverted LNG production stream through a first Knock Out drum so that the diverted LNG production stream exiting the first Knock Out drum is a first gas vapour stream;

depressurizing the diverted LNG production stream by passing the diverted LNG production stream directly from the first Knock Out drum through a JT valve and discharging the first gas vapour stream into a second Knock Out drum; and removing the produced LNG from the diverted LNG production stream in the second Knock Out drum;

wherein cooling the diverted LNG production stream to produce LNG consists of using reduced temperatures generated by depressurizing the gas to end users stream and the diverted LNG production stream.

* * * * *